US008656603B1

(12) United States Patent
Rush

(10) Patent No.: US 8,656,603 B1
(45) Date of Patent: Feb. 25, 2014

(54) HANDHELD TOOL FOR SPACING CLAPBOARDS

(76) Inventor: David Rush, Homer, AK (US)

( * ) Notice: Subject to any disclaimer, the term of this patent is extended or adjusted under 35 U.S.C. 154(b) by 189 days.

(21) Appl. No.: 13/370,531

(22) Filed: Feb. 10, 2012

(51) Int. Cl.
*G01D 21/00* (2006.01)
*G01B 5/25* (2006.01)

(52) U.S. Cl.
USPC ..... 33/647; 33/613

(58) Field of Classification Search
USPC ..... 33/613, 645, 646, 647, 648, 649
See application file for complete search history.

(56) References Cited

U.S. PATENT DOCUMENTS

| | | | | | |
|---|---|---|---|---|---|
| 572,582 | A * | 12/1896 | Stevenson | 33/647 |
| 1,137,619 | A * | 4/1915 | Higgens | 33/648 |
| 1,989,141 | A * | 1/1935 | Leonard | 33/648 |
| 3,463,480 | A * | 8/1969 | Edstrom | 33/646 |
| 4,164,346 | A * | 8/1979 | Sickler | 33/647 |
| 5,692,311 | A * | 12/1997 | Paquin | 33/647 |
| 6,367,160 | B1 * | 4/2002 | Rempe | 33/647 |
| 7,159,328 | B1 * | 1/2007 | Duda | 33/647 |
| 7,546,692 | B2 * | 6/2009 | Simko | 33/647 |
| 7,694,429 | B2 * | 4/2010 | Duquette et al. | 33/647 |
| 2004/0221467 | A1 * | 11/2004 | Chillington | 33/649 |
| 2010/0018070 | A1 * | 1/2010 | Duquette et al. | 33/647 |
| 2013/0031867 | A1 * | 2/2013 | Duquette et al. | 33/647 |

* cited by examiner

*Primary Examiner* — G. Bradley Bennett
(74) *Attorney, Agent, or Firm* — Michael J. Tavella

(57) ABSTRACT

A hand held gauge that contains all of the essential tools a worker needs to install clapboards. The tool is a hand-held device that has a pair of fixed flanges that are relatively long and extend out sideways from the handle for several inches on each end. The flanges are fixed in place. The tool also has the ability to establish proper measurements for window casings and doorframes. This is done by an adjustable gauge that can be extended forward until the casing or frame is reached. One this spacing is obtained; a worker can quickly transfer the measurement to the next piece of clapboard so that it can be cut. The tool includes a level and a tape measure and an optional straight edge for a marking square, so that simple measurements can be made without having to put down the tool and get another tool, which improves productivity.

15 Claims, 6 Drawing Sheets

HANDHELD TOOL FOR SPACING CLAPBOARDS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to tools for spacing clapboards and particularly to handheld tools for spacing clapboards.

2. Description of the Prior Art

The installation of clapboard siding is an age-old practice. Despite being centuries old, the practice of installing clapboards has one major problem. The installation requires the clapboards to be positioned at the correct height to provide proper spacing of the boards. Normally, installation crews have to mark out spacing using a variety of gauges and chalk lines to ensure proper spacing. This takes a lot of time and some skill.

Several tools have been invented to make this process easier and more reliable. Examples of some of these are found in following U.S. Patents. First, U.S. Pat. No. 5,094,007 shows an example of gauges—in this case, a sliding gauge based on a ruler. This does little more than set a spacing that can be repeated using the gauge. U.S. Pat. No. 4,937,950 teaches a spacer that has angle flanges that fit against one row of clapboards and a second flange that is used to place the next course upon. This device uses nails to hold it in place. It also is adjustable to change the spacing of the courses as desired. U.S. Pat. No. 7,543,422 teaches a variation of a spacing tool that is also adjustable and is secured to the building to use. U.S. Pat. Nos. 3,792,852 and 1,783,260 teach two more variants of gauges that are secured to the building and are adjustable.

U.S. Pat. No. 2,807,094 teaches a simple gauge that has two fixed flanges. The gauge is secured to the side of a hammer and is used to quickly space shingles before nailing. U.S. Pat. No. D338,814 teaches a hand held gauge that is fixed and has two simple flanges for spacing.

All of these devices are useful, but lack key features that make installing siding clapboards easier and faster. The adjustable gauges that attach to the house are problematic in that it takes time to nail them up and remove them. Also, the adjustability can cause problems in that these tools are usually used in pairs. As such, if one tool is set at a slightly different length, the entire course of clapboards can be installed askew. Moreover, adjustable gauges can become loose and are not easy to maintain in one set position. Simple measuring gauges are also good—to a point. The gauge must be used each course. This is also time consuming as it has be placed and then a mark made.

The fixed hand-held gauges are the best in that two workers can place clapboards up quickly and easily. The gauges can be quickly positioned, the new clapboard set and checked and nailed in place. The only problem they have is that there is no way to use the gauges when windows, doors and other openings are present. For those cases, the clapboards have to be carefully marked and cut to work around the frames.

BRIEF DESCRIPTION OF THE INVENTION

The instant invention overcomes these difficulties. It is a hand held gauge that contains all of the essential tools a worker needs to install clapboards in one frame. The tool is a hand-held device that has a pair of fixed flanges. These flanges are relatively long and extend out sideways from the handle for several inches on each end. This ensures that the clapboards are held securely and accurately by the tools (with long flanges, there is no way to turn the toll at a slight angle, thereby changing the spacing—that is possible when using some narrower tools). The flanges are fixed because in practice there are only two spacings for clapboards. Thus, a worker only needs two tools—one for each of the spacing sizes. More importantly, the tool has the ability to establish proper measurements for window casings and doorframes that can be obtained quickly using only the tool. This is done by an adjustable gauge that can be extended forward until the casing or frame is reached. Once this spacing is obtained, a worker can quickly transfer the measurement to the next piece of clapboard so that it can be cut. The tool includes a level and a tape measure so that simple measurements can be made without having to put down the tool and get another tool; all of which improves productivity.

DETAILED DESCRIPTION OF THE INVENTION

Figure 1:
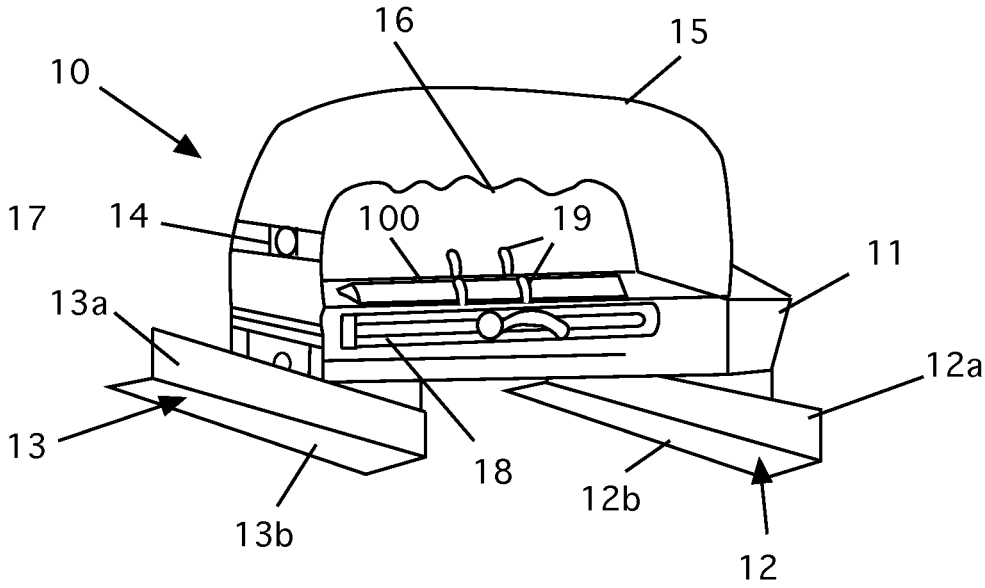
FIG. 1 is a perspective view of the invention.

Referring now to FIG. 1, a perspective view of the invention 10 is shown. The invention has a lower body 11 that has a rear flange 12 and a front flange 13 attached to the bottom and extending downward therefrom. Note that the flanges 12 and 13 have a vertical portion 12*a* and 13*a* and a horizontal portion 12*b* and 13*b*. The flanges are designed to rest against clapboards. In use, the rear flange is placed under the last clapboard installed. The next piece of clapboard is set in the front flange. Note that two tools are used in this process. Once the new clapboard is set in the flange, it is automatically spaced at the proper height. It can then be nailed in place. To ensure that clapboards are installed properly, a bubble level 14 is placed in the handle 15. The handle 15 is curved as shown and has handgrips 16 for comfort. When installers encounter obstacles such as vents or windows, the installers can easily measure for the necessary cuts using the installed tape measure (the tab end 17 is shown, see also FIG. 7), which is a convention metal spring type tape measure, and the window gauge 18, which is discussed in greater detail below. Finally, the body 11 has clips 19 that can hold a carpenter's pencil 100.

Figure 2:
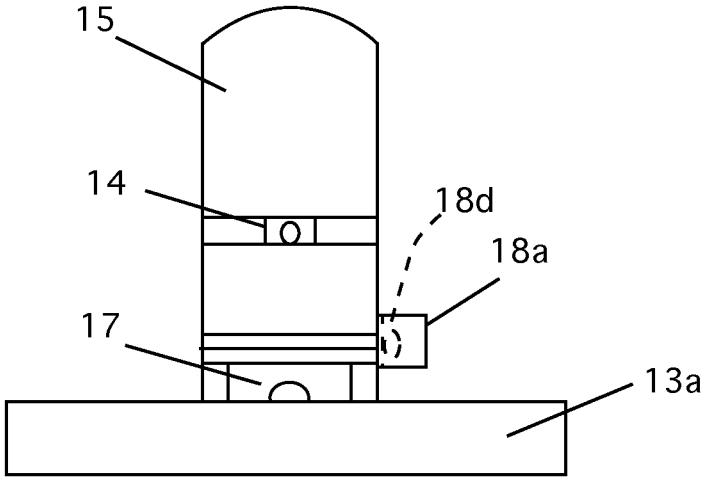
FIG. 2 is a front elevation view of the invention.

FIG. 2 is a front elevation view of the invention. In this view, the vertical portion 13*a* of the front flange is shown. Above the flange is the tab end 17 of the tape measure. At the right side is the front flange 18*a* of the window gauge 18. Finally, the bubble level 14 is shown installed in the handle portion 15.

Figure 3:
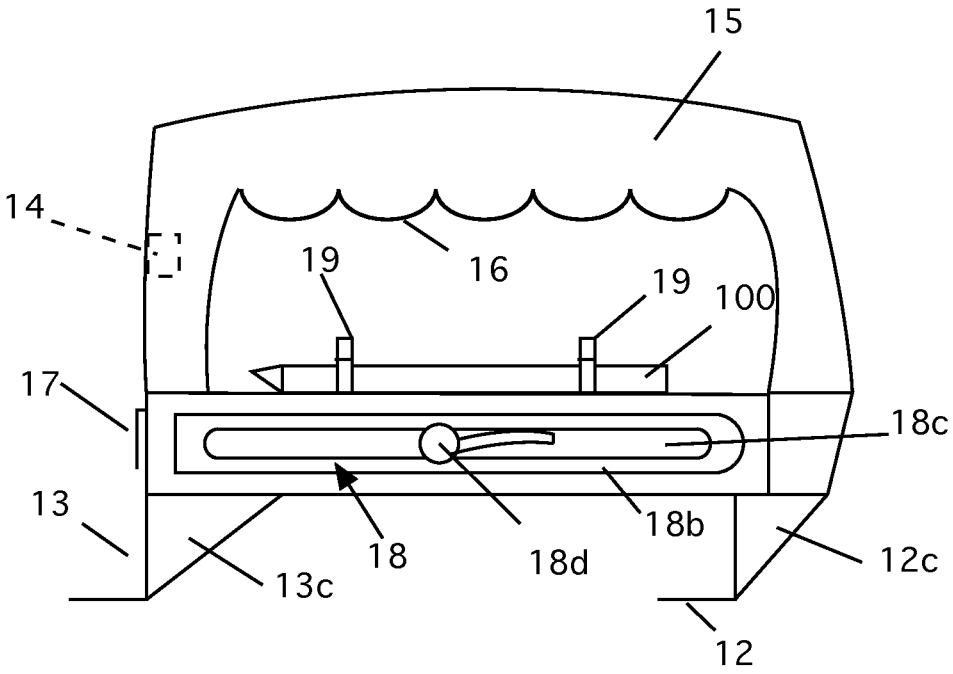
FIG. 3 is a right side elevation view of the invention showing the window gauge retracted.
Figure 6:
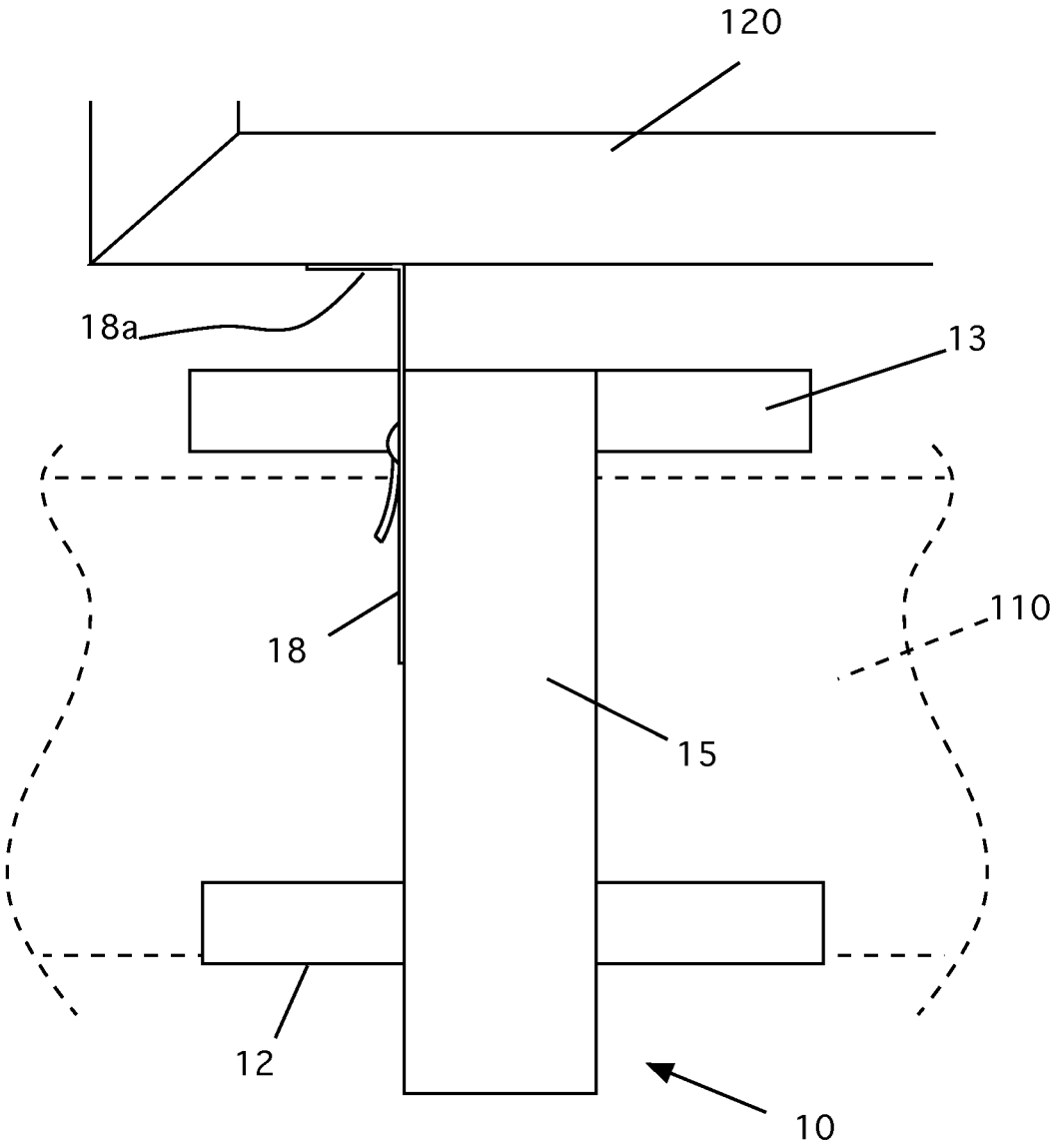
FIG. 6 is a top view of the invention on a wall showing the window gauge extended and aligned with a windowsill.

FIG. 3 is a right side elevation view of the invention showing the window gauge retracted. Here, the body 11 of the tool is shown with flanges 12 and 13. The handle 15, the bubble level 14, shown in dashed lines and the tab end 17 of the tape measure. Also shown is the pencil 100 held by clips 19. Mounded on the side of the body 11 is the window gauge 18. The window gauge is a bar 18*b* that has an opening 18*c* in the center that permits the bar to slide back and forth. A locking handle 18*d* is positioned as shown. The locking handle has two functions. First, it limits the lateral movement of the bar. It also serves to lock the bar in whatever position is desired (within the limits, of course). At the end of the bar is a flange 18*a* (see FIG. 2). FIG. 6 shows the window gauge in use.

Note too, that in the preferred embodiment, both the front and rear flanges have rear support gussets 12*c* and 13*c*. These gussets are preferably formed of molded plastic and are used to provide support for the vertical portions of the flanges, to ensure they maintain their position.

As noted, both the front and rear flanges are fixed. This is because there are only two spacing distances used in the art. These are 6 inches and 8 inches. Thus, a worker only needs two tools-one set at 6 inches and one set at 8 inches to be able to install clapboard siding in all applications.

Figure 4:
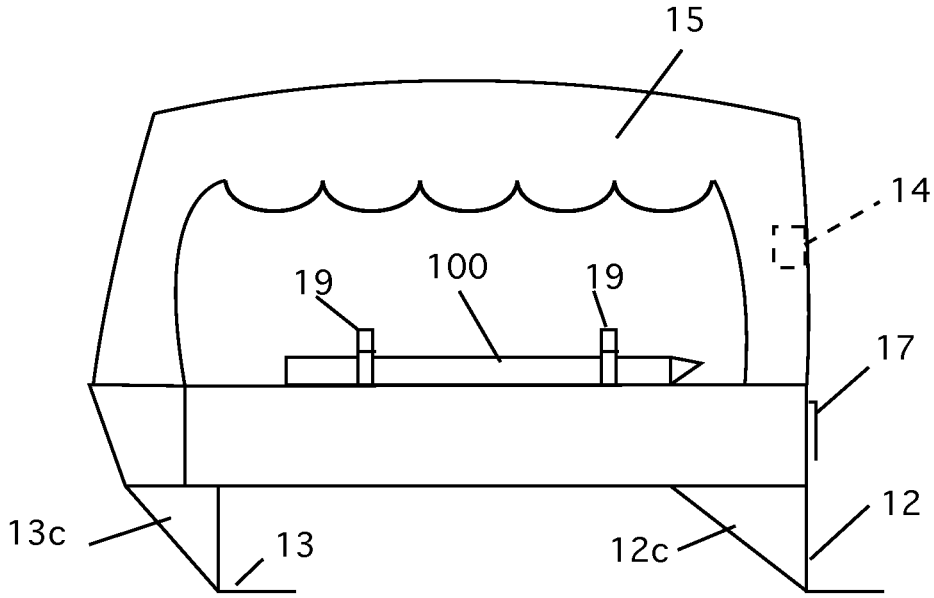
FIG. 4 is a left side elevation view of the invention showing the window gauge retracted.

FIG. 4 is a left side elevation view of the invention showing the window gauge retracted. In this view, the basic components of the tool, as discussed above are shown: the body 11, the handle 15, the bubble level 14, the tab end of the tape 17, the flanges 12 and 13, the pencil 100 and clips 19.

Figure 5:
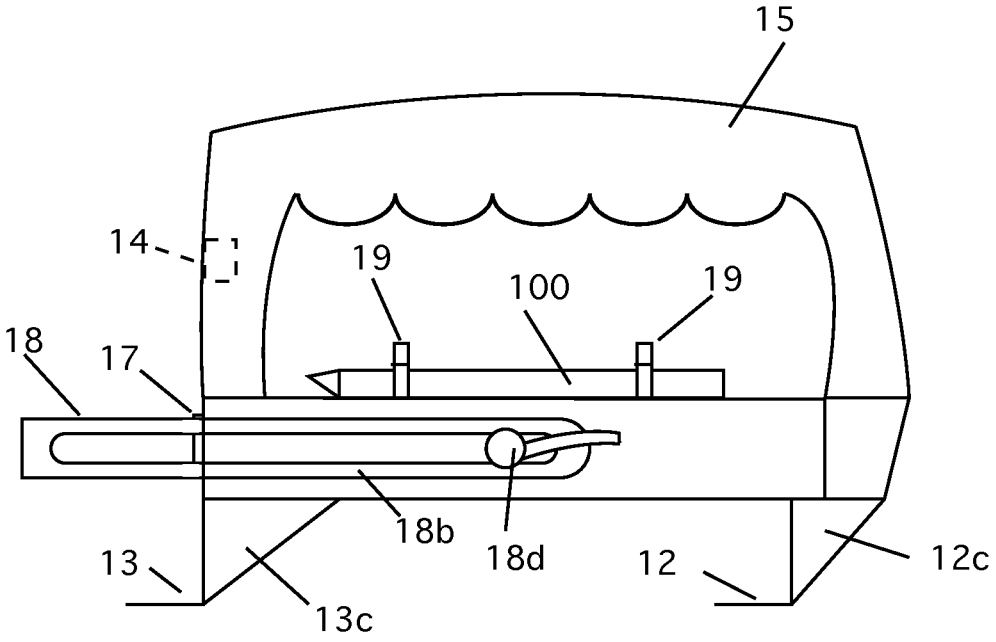
FIG. 5 is a right side elevation view of the invention showing the window gauge extended.

FIG. 5 is a right side elevation view of the invention showing the window gauge extended. Here, the body 11 of the tool is shown with flanges 12 and 13. The handle 15, the bubble level 14, shown in dashed lines and the tab end 17 of the tape measure. Also shown is the pencil 100 held by clips 19. As discussed above, the window gauge 18 is shown. In this view, the window gauge is shown extended. The bar 18*b* is pushed forward. This is the manner is which the gauge is used, as discussed below.

FIG. 6 is a top view of the invention on a wall showing the window gauge extended and aligned with a windowsill. In this view, the tool is positioned on the last set clapboard 110. The next clapboard is normally placed in the top flange and then nailed in place. However, a window 120 interferes with the clapboard placement. To account for this, the worker places the tool as shown and extends the window gauge forward, until the flange 18*a* contacts the bottom of the windowsill (as shown). The worker then measures the distance from the end of the clapboard to the edge of the window frame and the length of the window frame. With this information, the worker can go to the next clapboard, and mark the clapboard to account for the window. This can be done as simply as placing the tool with the rear flange against the bottom of the clapboard at the mark for the beginning of the window and, then sliding the tool along the clapboard with a pencil held on the end 18*a* of the window gauge, marking the depth of the window frame. One marked, the clapboard can be cut and positioned quickly and efficiently. Similarly, this technique can be used to measure around other obstacles on a wall surface to ensure a fast and easy clapboard installation.

Figure 7:
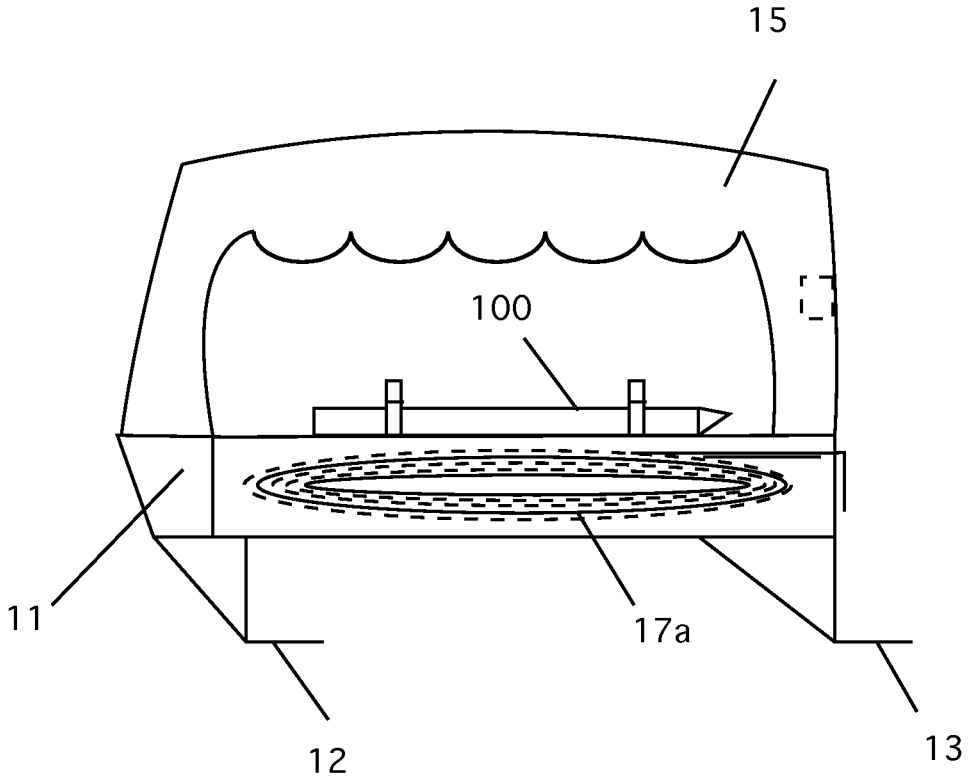
FIG. 7 is a left side cutaway view of the invention showing the tape measure installed in the lower body.

FIG. 7 is a cutaway detail view of the device showing the tape measure 17*a* installed in the lower portion 11.

Figure 8:
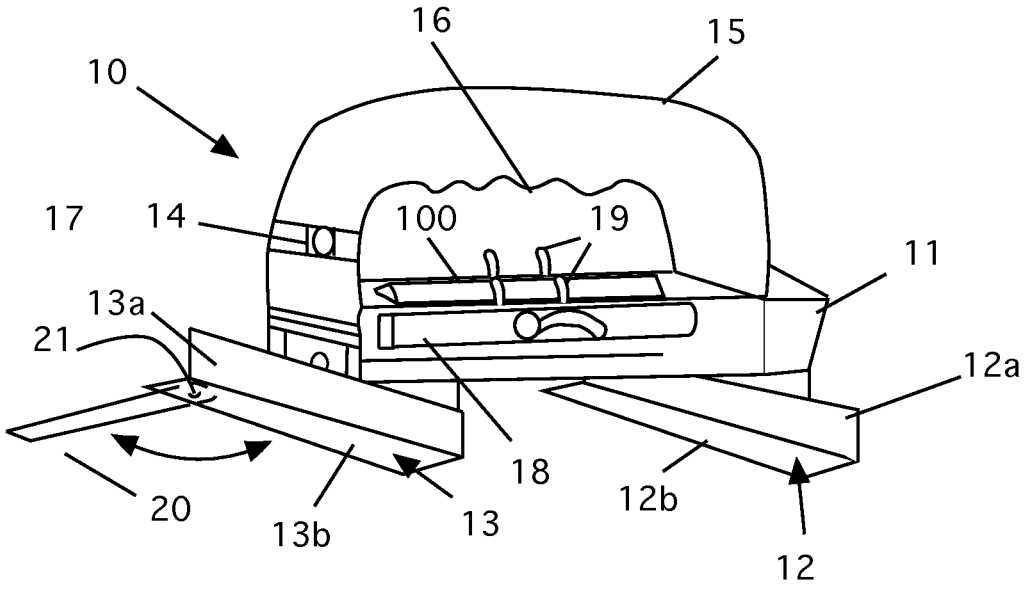
FIG. 8 is a detail view of an optional deployable straight edge, for use as a speed square, attached to the front flange.

FIG. 8 is a detail view of an optional deployable straight edge, for use as a marking square, attached to the front flange. In this view, a straight edge 20 is shown deployed. The straight edge 20 is pivotably attached to the bottom of the front flange 13 at one corner as shown. A pin or rivet 21 holds the straight edge in place. When not needed, the straight edge can be folded under the front flange, where it is out of the way of the normal use of the tool. When marking for a window opening, for example, using the window gauge, the depth of the cut can be marked on a piece of clapboard. The straight edge 20 can then be deployed to mark a vertical line for the cut. This is another time saving option for the tool in that a separate square need not be used to make these marks.

Figure 9:
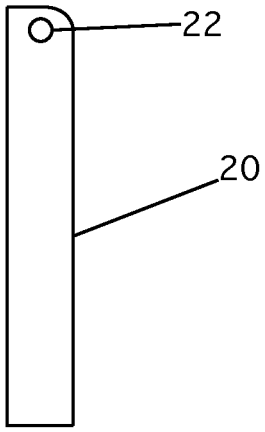
FIG. 9 is a top detail view of the straight edge.

FIG. 9 is a top detail view of the straight edge 20. The straight edge is simply a generally rectangular blade of thin aluminum. A hole 22 is formed to place the rivet or pin 21.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A handheld tool for spacing clapboards comprising:

a) a handle portion, having a width, a lower body and a grip portion, said handle portion having an opening between said lower body and said grip portion;

b) a rear flange, fixedly attached to said lower body and having a length at least 3 times the width of said lower body;

c) a front flange, fixedly attached to said lower body at a spaced apart-interval from said rear flange, and having a length at least 3 times the width of said lower body;

d) a window gauge, slidably attached to said lower body such that said window gauge can be extended laterally forward from said lower body; and e) a means for locking said window gauge in a temporary position with respect to said lower body.

2. The tool of claim 1 wherein said front flange is spaced about 6 inches forward of said rear flange.

3. The tool of claim 1 wherein said front flange is spaced about 8 inches forward of said rear flange.

4. The tool of claim 1 wherein said front and rear flanges, each has a vertical portion, having a back face, and a horizontal portion.

5. The tool of claim 4 further comprising a front gusset portion attached to the rear face of said front flange.

6. The tool of claim 4 further comprising a rear gusset portion attached to the rear face of said rear flange.

7. The tool of claim 1 further including a bubble level installed in said handle portion.

8. The tool of claim 1 wherein the handle portion is curved and further wherein said handle portion includes handgrips.

9. The tool of claim 1 further comprising a tape measure, operably installed in said handle portion.

10. The tool of claim 1 further comprising a plurality of clips installed on said lower body for holding at least one accessory.

11. The tool of claim 10 wherein the at least one accessory is a carpenter's pencil.

12. The tool of claim 1 wherein the window gauge has a front flange, extending orthogonally from said window gauge.

13. The tool of claim 1 wherein the means for locking said window gauge in a temporary position with respect to said lower body comprises a locking handle.

14. The tool of claim 1 further comprising a straight edge, pivotably attached to said front flange.

15. The tool of claim 14 wherein when said pivotable straight edge is pivoted to an orthogonal position with respect to said front flange, said straight edge and front flange form a marking square.

* * * * *